United States Patent [19]

Kent

[11] Patent Number: 4,922,841

[45] Date of Patent: May 8, 1990

[54] METHOD AND APPARATUS FOR USING HAZARDOUS WASTE TO FORM NON-HAZARDOUS AGGREGATE

[76] Inventor: John M. Kent, P.O. Box 1649, Slidell, La. 70459

[21] Appl. No.: 362,352

[22] Filed: Jun. 6, 1989

Related U.S. Application Data

[63] Continuation of Ser. No. 244,017, Sep. 14, 1988, abandoned.

[51] Int. Cl.[5] ..... F23G 5/00; F23G 5/12

[52] U.S. Cl. ..... 110/346; 110/211; 110/212; 110/214; 110/215; 110/235; 110/238; 110/246; 110/259

[58] Field of Search ..... 110/346, 235, 341, 246, 110/238, 345, 259, 212, 213, 214, 205, 211; 432/113

[56] References Cited

U.S. PATENT DOCUMENTS

| | | | |
|---|---|---|---|
| 3,592,151 | 7/1971 | Webber . | |
| 3,618,537 | 11/1971 | Bogue et al. . | |
| 3,697,256 | 10/1972 | Engle . | |
| 3,766,866 | 10/1973 | Krumm . | |
| 3,848,548 | 11/1974 | Bolejack, Jr. et al. | 110/346 |
| 3,938,449 | 2/1976 | Frisz et al. . | |
| 4,063,903 | 12/1977 | Beningson et al. . | |
| 4,193,354 | 3/1980 | Woods . | |
| 4,270,470 | 6/1981 | Barnett et al. . | |
| 4,308,809 | 1/1982 | Woods . | |
| 4,361,100 | 11/1982 | Hinger | 110/238 |
| 4,398,475 | 8/1983 | McKiel, Jr. . | |
| 4,598,650 | 7/1986 | Schneckenberger | 110/246 |
| 4,602,574 | 7/1986 | Bach et al. . | |
| 4,658,736 | 4/1987 | Walter . | |
| 4,667,608 | 5/1987 | Chang . | |
| 4,682,548 | 7/1987 | Peng . | |
| 4,794,871 | 1/1989 | Schmidt et al. | 110/246 X |

OTHER PUBLICATIONS

Hazardous Materials and Waste Management, Nov.--Dec., 1987, W. R. Duffett, pp. 15-17, "Slagging Kiln 'Fired Up' to Meet PCB Disposal Needs".

Literature brochure from Von Roll Inc., pp. 1-21.

Brochure from Phillips Petroleum Company, May 1987 and Phillips Petroleum News Release, Jun. 4, 1987.

C-E Raymond literature brochure, pp. 1-9, 11-12.

Ford, Bacon and Davis, Thermal Waste Destruction systems.

C-E Raymond Rotary Incinerator Systems Brochure, Solutions for Hazardous and Toxic Waste Disposal, 1987, pp. 1-8.

Experience in Slagging Pyrolysis Systems, A. Eggen and O. A. Powell, Jr., originally presented before the Incinerator Division Research Committee, Oct. 28, 1971, pp. 257-269.

*Primary Examiner*—Edward G. Favors

*Attorney, Agent, or Firm*—Finnegan, Henderson, Farabow, Garrett & Dunner

[57] ABSTRACT

Hazardous waste is formed into non-hazardous non-leaching aggregate by introducing the material to a rotary kiln where the large solids are at least partially combusted to form a primary aggregate. Gaseous combustion by-products and waste fines from the waste materials are introduced into at least one oxidizer operating at a temperature in the range of from about 1800° to 2500° F. Under such conditions, some of the waste fines are melted to form a slag-like material that is cooled to form the non-hazardous aggregate. The portion of the material in the oxidizer that is not melted, is cooled, neutralized and subjected to a solid gas separation. The solid is reintroduced to the oxidizer with the primary aggregate where they are either melted or entrained within the molten material and become an integral part of the non-hazardous aggregate.

59 Claims, 3 Drawing Sheets

METHOD AND APPARATUS FOR USING HAZARDOUS WASTE TO FORM NON-HAZARDOUS AGGREGATE

This application is a continuation of application Ser. No. 244,017, filed Sept. 14, 1988, now abandoned.

BACKGROUND OF THE INVENTION

The present invention relates to a method and an apparatus for using hazardous waste to form non-hazardous aggregate by thermally induced oxidation.

Many industrial processes produce by-products and waste materials that cannot be legally disposed of without some type of containment or treatment. Efforts in the past to dispose of such materials within containment vessels have proved inadequate since lack of attention to the manufacture of such containment vessels or their deterioration results in leakage or spillage of the hazardous waste. Other means of treating hazardous waste include the injection of such materials into wells, however, such materials may not be immobile within the strata into which they are injected and may find their way into underground aquifers.

In addition to the technical problems associated with such disposal techniques, there remains potential liability for anyone using such facilities. Years after the materials are deposited at the disposal site, claims for liability can be generated based on the knowledge that a party has been responsible for placing hazardous material within an approved waste disposal site only to have the disposal site be unsuccessful in preventing dispersion of the waste. Such problems have generated a search for means of using hazardous waste in a manufacturing process to eliminate its hazardous nature to produce a product suitable for sale to and use by the general public. One of the means attempted has been to oxidize the material by passing it through various types of heaters under oxidizing conditions. One such variation of such a process uses a counter current rotary kiln to induce combustion of the combustible components in the hazardous waste and to aggregate the non-combustible material into a form that could be sold as a commercially valuable and useful product.

Efforts in this particular method of waste use have been partially successful in manufacturing a product that will pass the applicable EPA regulations associated with the disposal of waste. These processes, however, have significant shortcomings. The most significant shortcoming associated with the use of hazardous waste in a rotary kiln or the like is the generation of additional non-combustible material that is not formed into an aggregate and must be disposed of as hazardous waste. Thus, although the amount of the hazardous waste has been significantly reduced by the process, there still remains the problem of disposal of a portion of the treated material as hazardous waste material. In addition, most conventional processes generate large quantities of contaminated scrubber water that must be treated and disposed of.

Therefore, it is one object of the present invention to provide a method and an apparatus for using hazardous waste material as a recyclable material in a manufacturing process such that the only products of such a process are non-hazardous and may be sold for use by the general public without concern as to the nature of the input materials that were processed.

It is another object of the invention to convert hazardous solid materials to a non-hazardous, inert aggregate that may be sold without restriction.

It is another object of the invention to make use of hazardous waste liquids as fuels and fuel supplements in lieu of natural gas or coal in an economical fashion where any solids resulting from the use may be sold to the general public without concern as to the hazardous nature of the input materials.

It is an additional object of the invention to provide a system for the use of hazardous waste materials on a large scale that can be operated economically without significant risk to personnel operating the system. These and other objects of the invention will be more fully disclosed in the present specification or may be apparent from practice of the invention.

SUMMARY OF THE INVENTION

To achieve these and other objects of the invention, there is provided a process for converting hazardous waste to non-hazardous aggregate. The process includes the step of providing a source of solid waste material comprised of large solid waste and waste fines. These materials are separated and the large solid waste is introduced to a rotary kiln having an input portion, a combustion portion and an exit portion. Operating conditions in the kiln are controlled such that large solid waste is combusted to form solid particulate primary aggregate, clinker and gaseous combustion by-products. A major portion of volatile combustibles in the large solid wastes are volatilized in the input portion of the kiln. The gaseous combustion by-products from the kiln are passed therefrom by means of an induced draft. The waste fines separated from the solid waste material are introduced to an oxidizing means along with combustible material. Combustion in the oxidizing means is induced to convert the waste fines into non-combustible fines, molten slag and waste gas. The temperature in the oxidizing means is controlled, preferably, in the range of from 1800° F. to 3000° F. The non-combustible fines and waste gas from the oxidizing means are passed therefrom by means of an induced draft. The non-combustible fines, the gaseous combustion by-products and the waste gas are cooled and the non-combustible fines are separated from the combustion products and waste gas. The solid particulate primary aggregate and non-combustible fines are reintroduced into the oxidizing means. Heat from the oxidizing means is impinged on the non-combustible fines and the primary aggregate to form molten slag. The molten slag is cooled to form the non-hazardous aggregate. It is preferred that when the primary aggregate and the non-combustible fines are introduced into the oxidizing means, they are introduced into the oxidizing means in discrete batch portions. It is further preferred that when those materials are introduced into the oxidizer means, they are introduced in the form of a pile where heat from the oxidizing means is impinged on the surface of the pile. It is further preferred that the rotary kiln operates at an average internal temperature in the range of from 1600° F. to 2300° F.

A preferred apparatus for carrying out the method of the present invention to convert hazardous waste into a non-hazardous aggregate includes a rotary kiln having an entry portion and an exit end. Oxidizing means are adjacent the entry portion of the kiln. There is also provided a source of solid waste material with the solid waste material comprising large solid waste and waste fines. Means for separating the large solid waste from the waste fines are included as are means for introducing the large solid waste to the entry portion of the rotary kiln. The device further includes means for inducing combustion in the kiln to convert the large solid waste to solid particulate primary aggregate, clinker, volatile gases and gaseous combustion by-products. Means are used to separate the clinker from the solid particulate primary aggregate. The device further includes means for passing the gaseous combustion by-products from the kiln and from the oxidizing means. Means are included for inducing combustion in the oxidizing means to convert the waste fines, the volatile gases and the gaseous combustion by-products into non-combustible fines, molten slag and waste gas. Cooling means cool the non-combustible fines in the waste gas and separating means separate the non-combustible fines and the waste gas. The device further includes means for introducing the solid particulate primary aggregate and reintroducing the solid non-combustible fines to the molten slag to form a substantially molten mixture. The device includes means for cooling the substantially molten mixture to form the non-hazardous aggregate. Preferably, the oxidizing means comprise a plurality of refractory-lined vessels in flow communication with the entry portion of the rotary kiln.

The present invention will now be disclosed in terms of preferred embodiments.

BRIEF DESCRIPTION OF THE DRAWINGS

The drawings, which form a portion of the specification, depict an embodiment of the invention.

DESCRIPTION OF THE PREFERRED EMBODIMENT

Figure 1:
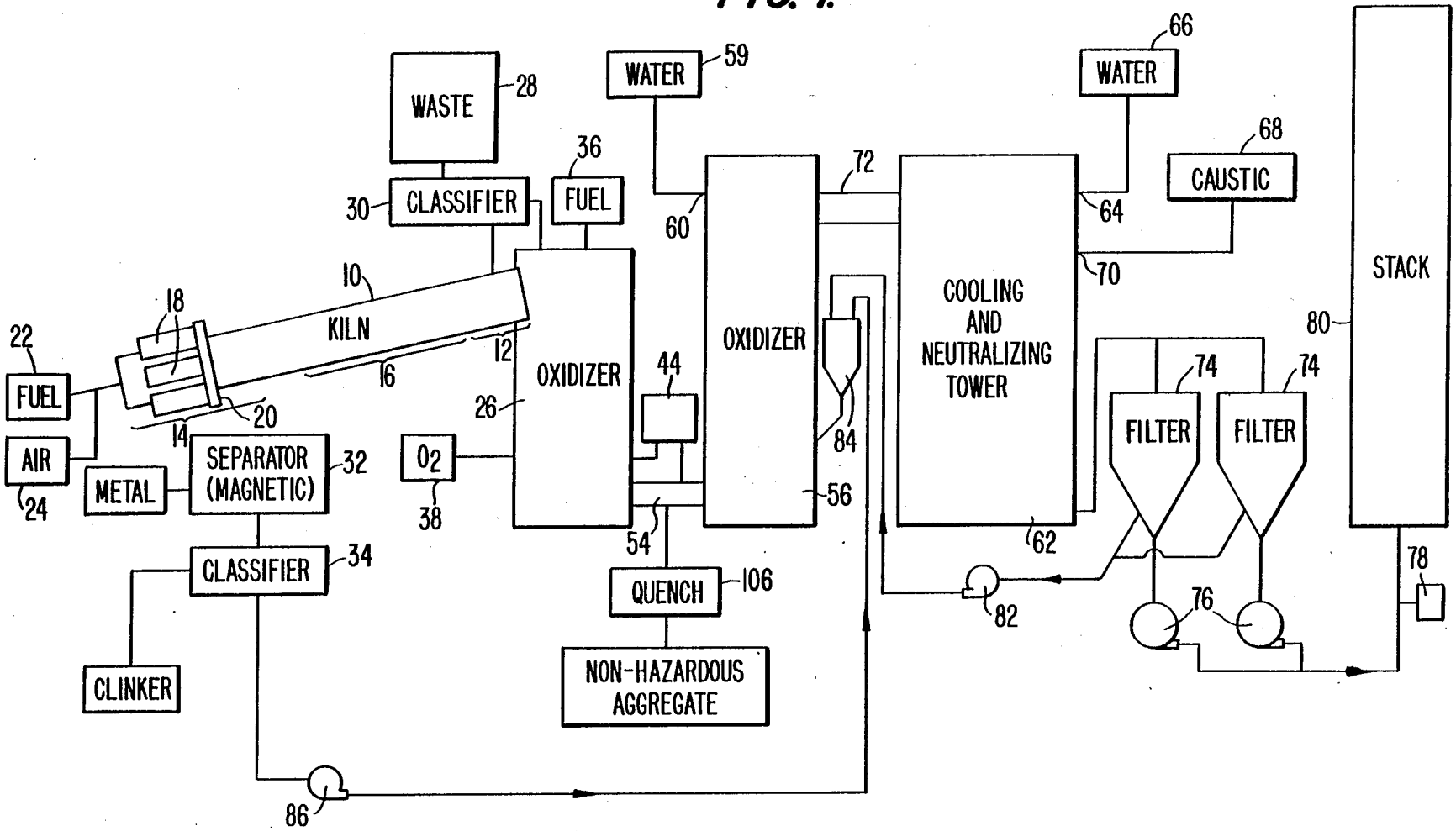
FIG. 1 is a schematic representation of one embodiment of the present invention.

The embodiment of the present invention is schematically depicted in FIG. 1.

The present invention is an apparatus for converting hazardous waste into non-hazardous aggregate and a process of operating apparatus for carrying out that function. In accordance with the invention, there is provided a rotary kiln having an entry portion and an exit portion. As here embodied and depicted in FIG. 1, the rotary kiln 10 includes an entry portion 12 and an exit portion 14. Located between the entry and exit portions of the rotary kiln, is the combustion portion 16. While in the embodiment depicted, the boundaries of the various portions are co-terminal, the three portions of the rotary kiln are merely illustrative and can overlap. That is to say some combustion may take place in the entry portion 12 or the exit portion 14, however, combustion takes place primarily in the combustion portion 16 of the rotary kiln 10.

The kiln depicted schematically in FIG. 1 is a standard counter current rotary kiln constructed for the treatment of limestone or oyster shell to form lime. It is comprised of an external metal shell that is lined with refractory brick. The composition of the refractory brick is determined by the operating temperatures and the materials passed through the rotary kiln. In the present embodiment where the rotary kiln is designed to operate at a temperature in the range of from 1600° F. to 2300° F., a refractory brick consisting of 70% alumina a product of the National Refractory Company of Oakland, Calif. has been used without premature refractory deterioration. The rotary kiln is supported on conventional bearing supports (not shown) and driven at rotational speeds in the range of 1 to 75 RPH by conventional kiln drive means (not shown).

As will be discussed in more detail hereinafter, solids are introduced to the entry portion 12 of the rotary kiln 10. As it rotates, the material larger than about 50 microns travels through the combustion zone 16 toward the exit portion 14 while the smaller material is entrained in the gas flowing counter current to the larger solid material. In the embodiment depicted, the rotary kiln 10 includes cooling chambers 18 on the exit portion of the kiln. The cooling chambers receive the solid material through ports communicating into the rotary kiln. The chambers receive the larger solid material which is transmitted by rotation to an exit chute 20 where the solid material issuing from the rotary kiln exits therefrom. Also associated with the rotary kiln 10 is a source of fuel 22 as well as a source of air 24 to support combustion within the rotary kiln 10. The fuel that can be used can be combustible liquid or gas, including combustible waste liquids, combustible liquid fuel or combustible natural gas. Oxygen, or water in combination are used to control temperatures and combustion. The air fuel mixture is introduced to the rotary kiln 10 at the exit portion 14 with gases in the kiln 10 passing toward the entry portion 12 counter-current to the larger solids being transported by rotation of the kiln toward the exit portion 14. As noted previously, the smaller particles are entrained in the gases passing through the kiln and are thus separated from the larger solids and transported from the kiln.

In accordance with the invention, the apparatus includes oxidizing means adjacent the entry portion of the kiln. As here embodied, the apparatus includes a first oxidizer 26. As shown in FIG. 1, the first oxidizer 26 is adjacent to the entry portion 12 of the rotary kiln. The oxidizer 26 is in flow communication with the entry portion 12 of the rotary kiln 10 and receives volatile gas driven off the material introduced to the rotary kiln as well as the combustion by-products from the combustion taking place in the rotary kiln. A source of waste material introduces material to the entry portion 12 of the kiln 10, where the counter-current gas flow effects a separation of the larger particles (solid waste material) and the smaller particles (waste fines). In accordance with the invention, the solid waste material is comprised of large solid waste and waste fines. For purposes of the present invention, large solid waste is waste having a particle size greater than about 50 microns whereas waste fines are defined as any material having a particle size less than 50 microns. While the apparatus is operable with materials separated to a different size, it is the purpose of the separation to provide material to the first oxidizer 26 than can be readily oxidized or melted in its physical state with the larger material being introduced to the kiln to be broken down during its transit through the rotary kiln to either incombustible material, volatile gas or combustion by-products.

In accordance with the invention, there are provided means for separating the large solid waste from the waste fines. As here embodied and depicted in FIG. 1, the apparatus includes a passive conveyor 30 which receives material from the waste source 28 and introduces the waste derived fuel into the entry portion 12 of the rotary kiln 10. Classifying of the large solid waste from the waste fines occurs throughout the rotary kiln 10. It should also be noted that the solid waste could also be separated by size prior to introduction into the kiln and the waste fines can then be directly introduced into the oxidizing means.

In accordance with the invention, the apparatus includes means for inducing combustion in the kiln to convert the large solid waste to solid particulate primary aggregate, clinker, volatile gases and gaseous combustion by-products. As here embodied and depicted in FIG. 1, the combustion inducing means include the fuel source 22, the oxygen source 24 and the rotary kiln 10. As will be disclosed hereinafter, the operating conditions in the kiln are such that the large solid waste is converted primarily to particulate primary aggregate, volatile gases and gaseous combustion by-products with the amount of clinker produced by the rotary kiln being minimal. Operation of the rotary kiln 10 passes the solids to the exit portion 14 of the rotary kiln through the cooling chambers 18 to the exit chute 20. As here embodied, the solid material exiting the exit chute 20 is sent to kiln classifier 34. Classifier 34 may be any conventional mechanism for separating large solid particles from fine solid particles. As here embodied, any solid material having a diameter in excess of $\frac{3}{8}$ inches is classified as clinker with anything less than that being primary aggregate. The clinker and particulate is passed over a magnetic separator 32. The primary aggregate is passed over another magnetic separator 32A. The ferrous metals are removed and sent to a metal bin for sale as scrap steel.

In accordance with the invention, there is provided means for inducing combustion in the oxidizer means to convert the waste fines, the volatile gases and the gaseous combustion by-products into non-combustible fines, molten slag and waste gas. As here embodied, the means for inducing combustion in the oxidizer means comprise the oxidizer fuel source 36 and oxygen source. Thus, the oxidizer 26 receives waste fines and volatile gases from the rotary kiln 10 which may or may not be combustible, combustion by-products from rotary kiln 10, fuel from fuel source 36 and oxygen from oxygen source 38. In the present embodiment, first oxidizer 26 operates at a temperature in the range of from 1800° F. to 3000° F. In an oxidizing environment, combustible materials within the first oxidizer 26 are converted to waste gas and non-combustible fines. The non-combustible fines may or may not be melted depending on their composition.

Figure 2:
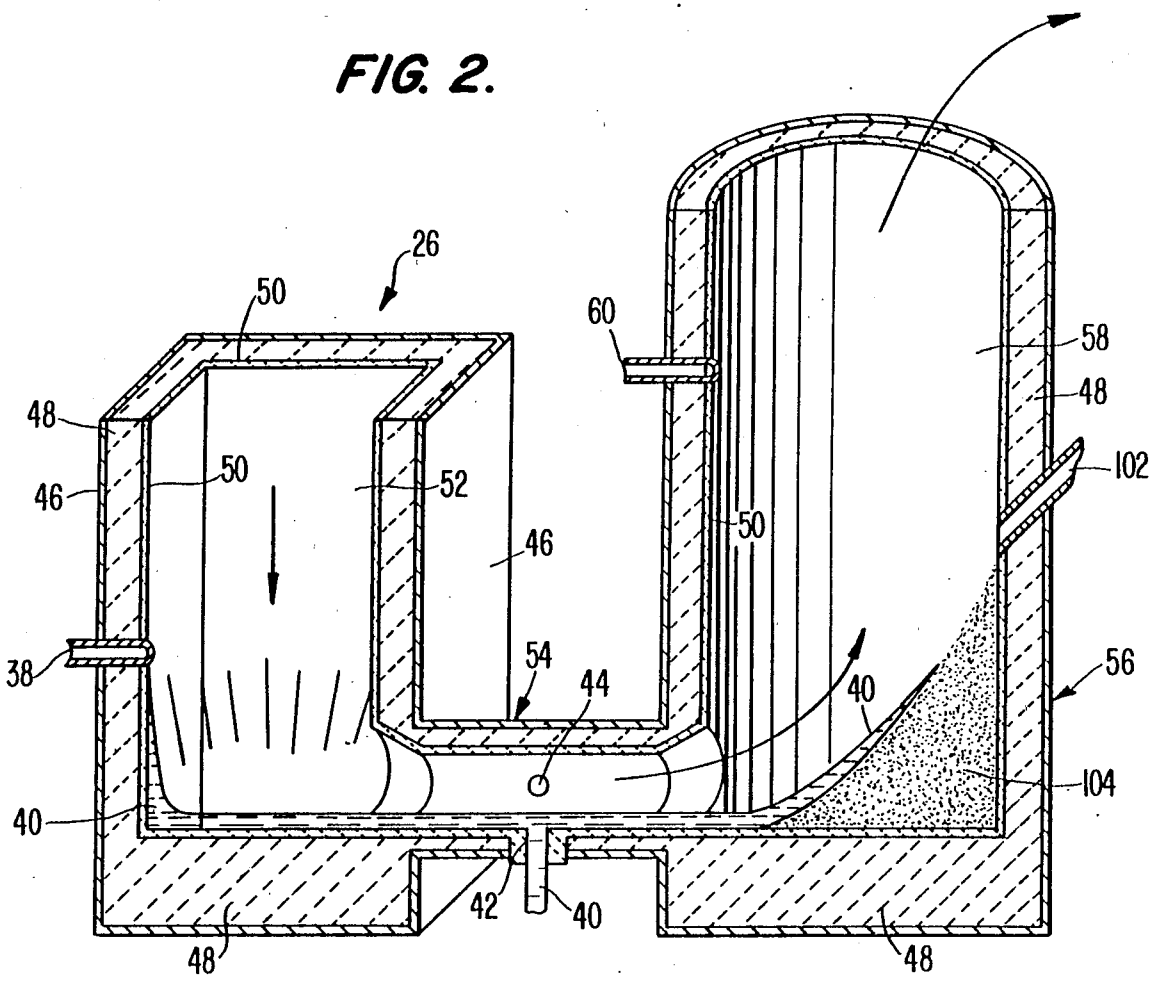
FIG. 2 is a schematic partial cross-section of the oxidizing means of the embodiment of FIG. 1.

As shown schematically in FIG. 2, a portion of the non-combustible fines are melted and collect at the bottom of first oxidizer 26 in the form of liquid slag 40. While in FIG. 2 the liquid slag is shown being removed from the apparatus by means of slag port 42, such a slag port may optionally be placed along the bottom of the first oxidizer 26. As shown in FIG. 2, the slag port 42 has associated therewith a burner 44 disposed to keep the materials adjacent the slag port 42 molten. The apparatus may optionally include a burner directed into first oxidizer 26 for the purpose of raising the temperature at various locations within the oxidizer 26.

As depicted schematically in FIG. 2, first oxidizer is a refractory-lined vessel in flow communication with the entry portion 12 of the rotary kiln 10. The first oxidizer in the present embodiment has a square cross section and includes a metal shell 46 having an interior refractory lining. The refractory lining in the embodiment depicted includes refractory brick 48 and a monolithic refractory lining 50. In the embodiment depicted, the refractory brick is 70% alumina made by the National Refractory Company of Oakland, Calif. The monolithic lining is JadePak made by the A. P. Green Company of Mexico, Mo. In this embodiment the refractory brick at the bottom of the first oxidizer 26 is significantly thicker than the refractory brick in the wall section of first oxidizer 26. This is the result of the operating temperatures at that portion of the oxidizer caused by the flowing liquid slag 40 transmitting heat from the hot gases passing through the interior portion 52 of the oxidizer 26. Another preferred embodiment of the first oxidizer would have a water cooled ceiling, water cooled metal walls and a refractory floor. Such a construction allows higher operating temperatures.

In the embodiment of FIG. 2, the hot gases are turned 90 degrees toward conduit 54 connecting the first oxidizer 26 with a second oxidizer 56. The construction of the second oxidizer 56 is similar in some respects to that of the first oxidizer 26. In the embodiment shown, however, the second oxidizer 56 is cylindrical with an interior 58 that is also cylindrical. The hot gases and particulate fines pass from the first oxidizer 26 through the conduit 54 to the second oxidizer 56. The construction of the conduit 54 and the second oxidizer 56 is similar to that of the depicted embodiment of the first oxidizer in that they are refractory lined steel structures. The refractory used in the conduit 54 is JadePak and the refractory used in the second oxidizer 56 is JadePak. Similar to first oxidizer 26, second oxidizer 56 also includes multiple layers of refractory brick at the bottom portion thereof. The function of this multiple layer of refractory has been discussed above.

In the embodiment depicted, not all of the combustion of waste materials occurs in first oxidizer 26. A significant portion also occurs in second oxidizer 56. Thus, the operation of the embodiment of FIG. 1 non-combustible waste fines pass from the interior portion 52 of first oxidizer 26 through the conduit 54 into the interior portion 58 of the second oxidizer 56.

In a preferred embodiment liquids are injected into second oxidizer 56 as here embodied through liquid inlet 60. The source of liquid for liquid inlet 60 in the present embodiment comprises a sump system (not shown) surrounding the entire apparatus. Any liquid, including waste derived fuels, rain water or contaminated rain water are collected in a sump system and injected into the second oxidizer 56 through liquid inlet 60. Thus, the overall apparatus has means for using waste derived fuel and contaminated water surrounding the apparatus within the apparatus itself. One skilled in the art to which the invention pertains can readily design a drainage and sump system to be operable with the present invention without specific disclosure of such a system.

In accordance with the invention, there is provided a means for cooling the non-combustible fines and waste gas. As here embodied and depicted schematically in FIG. 1, there is included quench vessel 62. Quench vessel 62 includes a water inlet 64. In the present embodiment the water inlet 64 has therein a nozzle not shown that introduces water and air at greater than sonic velocities. In the present embodiment, the spray nozzle is a "sonic" model SC CNR-03-F-02 made by Sonic of N.J. In flow communication with the water inlet is a source of water 66. In the present embodiment the water source 66 is fed water that does not include waste. It is the function of the water from the water source 66 to cool the waste gas and non-combustible fines down to a temperature between about 350° F. to 400° F., such that the gas and particulate material can be separated by conventional separation means to be hereinafter disclosed. As here embodied and depicted in FIG. 1 schematically, there is a source of caustic material which is in flow communication with a spray nozzle 70 that introduces a caustic liquid as a spray into the dry spray reactor vessel 62. It is the function of the spray injection of caustic material to neutralize any acid within the waste gas.

In accordance with the invention, the apparatus includes means for passing the gaseous combustion by-products from the kiln and the waste gas from the oxidizer means. As here embodied, there is included a connector 72 in flow communication between the second oxidizer 56 and the dry spray reactor 62. The connector has a construction similar to that of the second oxidizer 56 number, namely, it is a refractory lined metal shell. Similarly, the dry spray reactor 62 is also a refractory lined metal vessel.

In making connections between the various elements of the present invention, the effect of differential thermal expansion must be considered because of the high temperatures of the materials within the oxidizers 26 and 56, conduit 54 and connector 72. In addition, significant temperature differentials in different portions of the apparatus exist so that accommodation at the interface between such portions must be made for expansion and contraction.

As will be hereinafter disclosed, the system is run at less than an atmospheric pressure. Thus, any leakage at the interface between portions of the apparatus is not detrimental to the performance of the apparatus so long as the amount of leakage is not so excessive to detrimentally effect the combustion of materials within the oxidizers. This requirement is not as critical in other portions of the device operating at lower temperatures.

Figure 3:
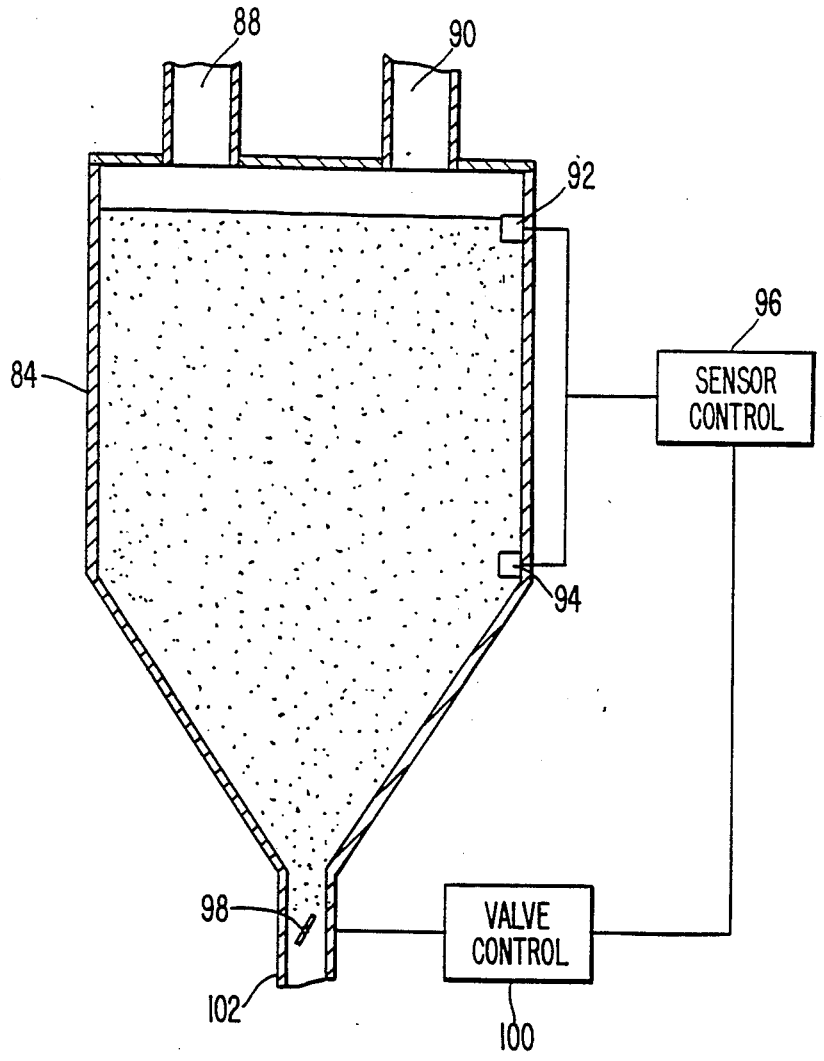
FIG. 3 is a schematic representation of an embodiment for accumulating particulate material that is introduced into the oxidizing means of the embodiments of FIGS. 1 and 2.

In accordance with the invention, the apparatus includes means for separating the non-combustible fines and the waste gas. As here embodied and depicted schematically in FIG. 1, the apparatus includes two filter systems operating in parallel, each including a filter 74 and a fan 76. The waste gas and particulate fines are introduced to the filter at a temperature preferably more than 350° F. and less than 400° F. so that conventional baghouse filters may be used. Operation of the present embodiment has determined that conventional teflon filter elements can be used in connection with this operation. The waste gas is separated from the non-combustible particulate fines and the waste gas is then passed by monitoring means 78 that monitor the composition and temperature of the waste gas. The waste gas is then passed into the atmosphere through stack 80. The fans 76 induce a draft throughout the entire apparatus drawing the volatile gases and combustion by-products from the rotary kiln. The combustion by-products from the rotary kiln, the combustion by-products from the oxidizers and all the gases passing through the system pass through the fan 76 such that the entire apparatus runs at sub-atmospheric pressure. The particulate fines accumulated in the filter 74 are passed by means of a pump means 82 to the accumulator 84. Similarly, the primary aggregate is passed through a pump 86 into the accumulator 84. The preferred embodiment of the accumulator 84 is depicted in FIG. 3.

In accordance with the invention, there is provided means for introducing the solid particulate primary aggregate and reintroducing the non-combustible fines to the apparatus to form a substantially molten mixture. As here embodied and depicted in FIGS. 1 and 2, the apparatus includes means of introducing the non-combustible particulate fines and the primary aggregate into the oxidizer means, specifically, the second oxidizer 56. As depicted in FIG. 3, the accumulator 84 includes a first inlet 88 disposed to receive particulate fines from pump 82. The accumulator 84 further includes a second inlet 90 disposed to receive primary aggregate through pump 86. Associated with the preferred embodiment of the accumulator 84 is a first sensor 92 for detecting the desired maximum level of particulate material within the accumulator 84. A second sensor 94 detects the level of particulate material within the accumulator 84 and by means of a sensor control mechanism operates a valve 98 by means of valve control means 100. During operation of the apparatus, the inlets 88 and 90 introduce particulate material into the accumulator 84 where it accumulates up to a predetermined level such that upper sensor 92 is activated, it through control sensor control means 96 and valve control 100 opens the valve 98, thereby allowing particulate material to pass through the conduit 102 into the second oxidizer 56 as depicted in FIG. 2. When the level of particulate material within the accumulator 84 reaches the level of lower sensor 94, the sensor control and the valve control 100 close the valve 98, thereby interrupting flow of particulate material through the conduit 102.

While the conduit 102 is shown introducing solid particulate material into the second oxidizer 56, solid particulate material may also be introduced into first oxidizer 26 or both the first and second oxidizers. As shown in FIG. 2, the solid particulate material introduced to the second oxidizer through conduit 102 falls into the central portion 58 of the second oxidizer 56 and forms a pile on the bottom. Heat from the gas passing through the second oxidizer 56 is impinged on the surface of the pile of particulate material melting the portion of the particulate material that has a melting point below that of the gas being impinged on the surface. The material flows from the pile 104 entraining any particulate material that is not melted therein and joins the molten slag 40 to flow from the slag port 42.

In accordance with the invention, the apparatus includes means for cooling the substantially molten mixture to form the non-hazardous aggregate. As here embodied, the device includes cooling means 106 depicted schematically in FIG. 1. In the preferred embodiment the cooling means simply comprise water into which the substantially molten mixture is dumped. The cooling means extract the heat from the molten mixture and form the non-hazardous aggregate.

Operation of the previously described apparatus will now be described in terms of a process for using hazardous waste in a manufacturing process to form a non-hazardous aggregate. In accordance with the invention, the first step of the process is providing a source of solid waste material that is comprised of large solid waste and waste fines. In the embodiment of the present invention, the waste is transported to the apparatus in various forms. The waste can be in the form of a particulate solid such as contaminated top soil, contaminated construction rubble, semi-solid sludge from a sewage treatment operation, metal drums of liquid waste, fiber drums (commonly referred to as lab packs) containing liquids or solids. When the waste material is a liquid bearing sludge, the waste is first passed over a shaker screen where the liquid is removed and introduced into the apparatus of the present invention separately from the solid residue. Where the waste is contained in 55 gallon metal drums, the drums are shredded and introduced into the rotary kiln as part of the large solid waste, thereby eliminating the need for cleaning or inspection of the drums. It may also be necessary to shred the input materials several times to obtain an input material that is efficiently consumed in the process.

In controlling the process and the operating temperatures of the various components carrying out the process, it is advantageous to know the certain characteristics of the input materials so that the feed rate of the waste materials and other input materials introduced to the apparatus can be controlled to obtain the desired operating conditions. Preferably, the waste material arrives with a description that would include a BTU and moisture content. It may also be necessary, however, to check the BTU content and other characteristics of the input materials so that the operation of the apparatus can be facilitated. It should be noted that while a load of waste material may have an overall BTU content of one value, many times the waste is non-homogenous and therefore the operation of the apparatus and the control of the process requires some intervention to prevent the operating parameters from deviating from that necessary to completely oxidize the combustible components of the waste and produce the desired non-hazardous aggregates. In addition to the BTU and moisture content, it is advantageous to also know the acid content, the amount of ash and the halogen concentration. The acid content of the waste provides the operator with means to assess how much caustic would be consumed in the process which impacts both the operation of the process and its economics. The amount of ash in the waste determines how much aggregate will be produced. The halogen content affects the operations of the process and preferably should be in the range of from 10 to 15%. Using these characteristics of the waste and by appropriately controlling the input of water, auxiliary fuel, oxygen, caustic, coolant and the like, to achieve the desired operating conditions the desired aggregate can be economically produced.

In accordance with the invention, the process includes the step of separating the large solid waste from the fines, as disclosed above, this separation may occur in the rotary kiln 10 or may be accomplished by simply directing the appropriately sized waste to different positions of the apparatus. For example, if the waste fines are contaminated top soil, they can be directly introduced to the oxidizing means.

In accordance with the invention, the process includes the step of introducing the large solid waste to a rotary kiln having an input portion, a combustion portion and an exit portion. The operating conditions in the kiln are controlled such that the large solid waste is combusted to form solid particulate primary aggregate, clinker and gaseous combustion by-products with a major portion of volatile combustibles in the large solid waste being volatilized in the input portion of the kiln. Preferably, the rotary kiln is operated at an average internal temperature in the range of from about 1600° F. to 2300° F.

It should be noted that there are considerable temperature gradients within the kiln, both along its length and in the radial direction. Therefore, portions of the kiln may deviate significantly from the range of from 1600° F. to 2300° F.

The large solid waste is introduced into the rotary kiln at a rate depending on its BTU content but normally at a rate of approximately 20 tons per hour. The kiln is rotated at a speed in the range of from 1 to 75 RPH such that the total residence time of solid material exiting the kiln at the exit portion 14 is in the range of from about 90 to 120 minutes.

At these operating parameters the rotary kiln produces a solid output consisting predominantly of solid particulate primary aggregate with a minor amount of material that can be classified as clinkers. For purposes of the present invention, clinkers are normally large sized solids, for example, construction bricks that pass through the rotary kiln unreacted or agglomerations of low melting point material that have melted and agglomerated at the relatively low temperatures in the rotary kiln. The operating conditions of the rotary kiln are controlled to facilitate two conditions.

First, to convert the major portion of the large solid waste into solid particulate primary aggregate and second, to volatilize a major portion of the volatile combustibles in the large solid waste in the input portion of the rotary kiln. As will be discussed hereinafter, the primary aggregate is recirculated into the process to be melted and introduced to the molten slag in the oxidizing means. Inasmuch as the slag is formed into the non-hazardous aggregate, it is desired to convert as much of the processed materials into that form as possible. The material forming the clinker output from the kiln is tested to determine if it has hazardous material that can be leached therefrom. Any material having leachable hazardous material is reintroduced into the rotary kiln at the input portion. Operation of the present apparatus and process results in a very minor portion of the output from the rotary kiln being classified as clinker material.

The second goal in operating the rotary kiln is to volatilize a major portion of the volatile combustibles in the input portion of the rotary kiln. This reduces the BTU content of the solid material passing through the rotary kiln into the combustion portion 16 of the rotary kiln. If the BTU content of the solid portion reaching the combustion portion 16 of the rotary kiln 10 is excessive, uncontrolled combustion can occur within the combustion portion of the kiln. Thus, the operating conditions of the rotary kiln should include a temperature at the input portion high enough to volatilize most of the volatile components in the large solid waste being introduced to the kiln.

As depicted schematically in FIG. 1, the solid material exiting the exit chute 20 is sent to kiln classifier 34. Classifier 34 may be any conventional mechanism for separating large solid particles from fine solid particles. As here embodied, any solid material having a diameter in excess of $\frac{3}{8}$ inches is classified as clinker with anything less than that being primary aggregate. The clinker and particulate is passed over a magnetic separator 32. The primary aggregate is passed over another magnetic separator 32A. The ferrous metals are removed and sent to a metal bin for sale as scrap steel.

In accordance with the invention, the gaseous combustion by-products from the kiln are passed therefrom by means of an induced draft. As disclosed above, the fan 76 maintains the entire apparatus at a sub-atmospheric pressure and draw the gas from the rotary kiln as well as the oxidizers through the entire system.

In accordance with the invention, the process includes introducing waste fines to oxidizing means. As here embodied, waste fines from rotary kiln 10 are entrained in the gas stream and carried into the oxidizer 26.

In accordance with the invention, combustible material is introduced into the oxidizing means. As here embodied, there is a source of liquid fuel 36 associated with the first oxidizer 26. The input of fuel, waste fines, volatile gases from the solid waste material in the kiln and oxygen injection are all used to control the temperature in the first oxidizer which should range from about 1800° F. to 3000° F. The temperature is determined by the BTU content of the input materials, including any auxiliary fuel that is introduced. Preferably, the auxiliary fuel from the fuel source 36 comprises combustible liquid waste material. It is further preferred that the combustible liquid waste material comprise a liquid which is either organic solvents, liquid drilling waste or paint.

In accordance with the invention, the process includes the step of inducing combustion in the oxidizing means to convert the waste fine to non-combustible fines, molten slag and waste gas. As here embodied, the oxidizing mean is comprised of two oxidizers, the first oxidizer 26 and second oxidizer 56. In the first oxidizer 26, a major portion of the combustible material is oxidized to form gaseous combustion by-products. These are drawn through the interior 52 of the first oxidizer 26 through the conduit 54 into the interior 58 of the second oxidizer 56. At the temperature of operation, 1800° F. to 3000° F. being preferred, some of the solid material is melted. This material collects at the bottom portion of the first oxidizer, as shown in FIG. 2 as the liquid slag 40, which then runs toward the slag port 42. The unmelted solid particulate material passes with the gaseous combustion by-products through the conduit 44 into the interior of oxidizer 56 where a portion may be melted in the second oxidizer 56 or it may remain unmelted and pass through the device as solid particulate fines.

In accordance with the invention, solid particulate primary aggregate and non-combustible fines are introduced into the oxidizing means. As here embodied and clearly depicted in FIG. 2, a conduit 102 introduces the primary aggregate and solid particulate fines to the interior of the second oxidizer 56. Preferably, the primary aggregate and solid particulate fines are introduced in discrete batch portions. Continuous introduction of these materials into the oxidizer cools the surface of the pile of particulate material within the oxidizer preventing melting of the surface. This inhibits the melting of the particulate material being introduced to the oxidizer and thereby inhibits the production of the molten slag that forms the non-hazardous aggregate.

As depicted schematically in FIG. 2, it is preferred that the discrete batch portions of primary aggregate and non-combustible fines be introduced to the second oxidizer to form a pile in the oxidizer. Heat from the oxidizing means is impinged on the surface of the pile whereupon material having relatively low melting points is melted to run down to the bottom of the oxidizer toward the conduit 54 where the molten material exits the slag port 42. The process may generate either slagged aggregate or non-combustible particulate fines that have a melting point higher than the temperature of the second oxidizer. Thus, such particular material would not be melted. It is, however, entrained within the molten material formed in the second oxidizer and into the slag to form a substantially molten mixture. By melting the surface of the pile and allowing the molten material and the solid particulate material entrained therein to run toward the conduit 54, this exposes a new surface on the particulate material that is then melted to run out of the apparatus through the slag port. While the embodiment shown herein illustrates the introduction of the primary aggregate and non-combustible particulate fines to the second oxidizer, the process is also operable if a portion of that material is introduced to the first oxidizer. It is also possible to separately inject the primary aggregate into either oxidizer or the particulate fines into either oxidizer, however, it is preferred to combine the particulate primary aggregate and non-combustible particulate fines and re-introduce them into the process as a combination.

The embodiment of FIG. 2 also shows an apparatus for injecting oxygen into the first oxidizer. The process is also operable with injection of oxygen into the second oxidizer. During preferred operation of the device, the average temperature in the first oxidizer is approximately 3000° F. Temperature in the conduit between the first and second oxidizer is 2800° F. and temperature in the second oxidizer is approximately 2800° F. It is also preferred that the second oxidizer be disposed to receive liquid in relatively small amounts such that any combustible hazardous waste within the liquid is oxidized within the oxidizer means. As here embodied, it is the second oxidizer 56 that includes a inlet 60. At the temperature of operation of the second oxidizer, the water is vaporized and the solids are introduced into the hot gas stream to be either combusted, melted or passed out with the other non-combustible particulate fines into the downstream section of the apparatus.

It is further preferred that the waste gas, the gaseous combustion by-products and non-combustible fines from the oxidizing means be cooled by an injection of water to form a cooled effluent. As here embodied and schematically depicted in FIG. 1, a dry spray reactor 62 includes means for injecting water into the dry spray reactor 62. Preferably, the water forms a cooled effluent having a temperature of less than about 400° F. and preferably more than 350° F. It is further preferred that any acids in the cooled effluent be neutralized. As here embodied and depicted schematically in FIG. 1, the apparatus includes means for introducing a caustic solution to form a neutralized effluent comprised of non-combustible fines and waste gas. Preferably, the waste gas is separated from the non-combustible fines by dry filtration. This step can be accomplished by passing the non-combustible fines and waste gas through a conventional baghouse. The fans associated with the baghouse, in this embodiment, fan 76 in FIG. 1, induce a draft throughout the entire apparatus such that the apparatus is operated at a pressure below atmospheric pressure.

In accordance with the invention, the process includes a step of cooling the mixture of molten slag and solid particulates to form a non-hazardous aggregate. In the preferred embodiment the mixture of molten slag and solid particulates is introduced to a water filled conveyer where the quenching effect of the water cools the mixture to form the solid non-hazardous, non-leaching aggregate. The water used to cool the molten material is then re-introduced to the process either with waste water into the second oxidizer or as water coolant into the quencher 62.

Operation of the present invention results in the production of four effluents: ferrous metal, which is passed through the rotary kiln and is thus free of hazardous material; clinker that is passed through the rotary kiln, which if it contains hazardous material is either bound into the structure of the clinker or is re-introduced to the process until the clinker composition is non-hazardous. The third effluent is the gaseous effluent from the stack 80 and consists primarily of carbon dioxide and water. While the preferred embodiment is not classified as a hazardous waste incinerator and is not subject to hazardous waste incineration requirements, its air quality permit is based on the same considerations applied to a Part "B" hazardous waste incinerator. The present invention readily meets such a criteria. In addition to meeting stringent air quality specifications, the aggregate produced from the process while containing heavy metals that would be hazardous if removable from the aggregate, has converted the material to a form where the heavy metals are bound into the glass-like aggregate. Specifically, the levels of arsenic, barium, cadmium, chromium, lead, mercury, selenium and silver are all well below the regulatory limit. In addition, the concentration of pesticide herbicide compounds, acid phenol compounds, base neutral compounds and other volatile compounds are well below the regulatory limits. Thus, although the input materials may contain hazardous materials, the materials are either oxidized by oxidation or locked within the structure of the aggregate such that the process produces no hazardous effluents.

The present invention has been disclosed in terms of a preferred embodiment. The invention, however, is not limited thereto. The scope of the invention is to be determined solely by the appended claims and their equivalents.

What is claimed is:

1. A process for using hazardous waste to form non-hazardous aggregate, said process comprising:

providing a source of solid waste material comprised of large solid waste and waste fines;

introducing said large solid waste to a rotary kiln having an input portion, a combustion portion and an exit portion;

separating said large solid waste from said waste fines;

controlling operating conditions in said kiln such that said large solid waste is combusted to form solid particulate primary aggregate, clinker, and gaseous combustion by-products;

a major portion of volatile combustibles in said large solid waste being volatilized in said input portion;

passing said gaseous combustion by-products from said kiln by means of an induced draft;

introducing said waste fines to oxidizing means;

introducing combustible material to said oxidizing means;

inducing combustion in said oxidizing means to convert said waste fines into non-combustible fines, molten slag, and waste gas;

controlling the temperature in said oxidizing means;

passing said non-combustible fines and said waste gas from said oxidizing means by means of said induced draft;

cooling said non-combustible fines, said gaseous combustion by-products and said waste gas;

separating said non-combustible fines from said gaseous combustion by-products and waste gas;

introducing said solid particulate primary aggregate and reintroducing said non-combustible fines into said oxidizing means;

impinging heat from said oxidizing means on said non-combustible fines and said primary aggregate to form a mixture of molten slag and solid particulates; and cooling said mixture of molten slag and solid particulates to form said non-hazardous aggregate.

2. The process of claim 1 wherein said primary aggregate and said non-combustible fines are introduced to said oxidizing means in discrete batch portions.

3. The process of claim 2 wherein said portions of primary aggregate and non-combustible fines form a pile in said oxidizing means.

4. The process of claim 3 wherein heat from said oxidizing means is impinged on the surface of said pile.

5. The process of claim 4 wherein said pile has a sloped outer surface with heat from said oxidizing means being impinged on said surface.

6. The process of claim 5 wherein said sloped outer surface is melted and molten material on said surface runs from said surface exposing a new surface of unmelted material on said pile.

7. The process of claim 1 wherein said rotary kiln is operated at an average internal temperature in the range of from about 1600° F. to 2300° F.

8. The process of claim 1 wherein the operating parameters of said rotary kiln are disposed to produce a solid output consisting predominantly of said solid particulate primary aggregate.

9. The process of claim 1 wherein said oxidizing means comprises a plurality of oxidizers, including at least a first and second oxidizer.

10. The process of claim 9 wherein said first oxidizer receives said waste fines, additional combustible material in the form of liquid fuel and said gaseous combustion by-products from said kiln, said first oxidizer operating at an average internal temperature ranging from about 1800° F. to 3000° F.

11. The process of claim 10 wherein said liquid fuel comprises combustible liquid waste.

12. The process of claim 9 including the step of reintroducing said non-combustible fines back into said first oxidizer.

13. The process of claim 9 including the step of introducing said solid particulate primary aggregate into said first oxidizer.

14. The process of claim 9 wherein a second oxidizer receives combustion by-products and non-combustible fines from said first oxidizer, said second oxidizer operating at an average internal temperature ranging from 1800° F. to 2800° F.

15. The process of claim 14, including the step of reintroducing said non-combustible fines back into said second oxidizer.

16. The process of claim 14 including the step of introducing said solid particulate primary aggregate to said second oxidizer.

17. The process of claim 14 including the step of mixing said solid particulate primary aggregate and said non-combustible fines and adding that mixture to said second oxidizer.

18. The process of claim 9 including the step of injecting oxygen gas into said first oxidizer.

19. The process of claim 9 including the step of injecting oxygen gas into said second oxidizer.

20. The process of claim 9 including the step of injecting waste liquid into said second oxidizer.

21. The process of claim 1 wherein said waste gas, gaseous combustion by-products and non-combustible fines from said oxidizing means are cooled by injection of water into said oxidizing means to form a cooled effluent.

22. The process of claim 21 wherein said cooled effluent is cooled to a temperature in the range of from 350° F. to 400° F.

23. The process of claim 21 wherein acids in said cooled effluent are neutralized.

24. The process of claim 23 wherein said acids are neutralized by introducing a caustic solution to form a neutralized effluent comprised of non-combustible fines and waste gas.

25. The process of claim 24 wherein said neutralized effluent is separated into non-combustible fines and waste gas by dry filtration.

26. The process of claim 25, wherein said step of dry filtration is effected by means of a baghouse.

27. The process of claim 1 wherein said kiln and said oxidizing means are operated at a pressure below atmospheric pressure.

28. The process of claim 1 including the step of cooling solid material issuing from said exit end of said kiln.

29. The process of claim 1 wherein said non-combustible fines and said solid particulate primary aggregate are accumulated within a container in flow communication with said oxidizing means.

30. The process of claim 29 wherein said non-combustible fines and said solid particulate primary aggregate are placed into said oxidizing means in response to said non-combustible fines and said primary aggregate reaching a pre-determined level in said container.

31. A process for using hazardous waste to form non-hazardous aggregate, said process comprising:

providing a source of solid waste material comprised of large solid waste and waste fines;

introducing said large solid waste to a rotary kiln having an input portion, a combustion portion and an exit portion;

separating said large solid waste from said waste fines;

operating said kiln at an average internal temperature ranging from 1600° F. to 2300° F. and at a pressure less than atmospheric;

volatilizing a major portion of the volatile combustible materials in said large solid waste in said input portion of said rotary kiln;

controlling conditions in said rotary kiln such that said solid waste is combusted into solid particulate primary aggregate, solid clinker and gaseous combustion by-products, with the major portion of solid material issuing from said exit portion of said kiln comprising solid particulate primary aggregate;

introducing said waste fines, said gaseous combustion by-products, auxiliary fuel and oxygen gas to a first oxidizer in flow communication with the input portion of said rotary kiln and inducing combustion, the temperature in said first oxidizer ranging from about 1800° to 3000° F;

melting a portion of said waste fines in said first oxidizer to form molten slag;

passing gaseous combustion by-products and unmelted particulate material from said first oxidizer to a second oxidizer in flow communication with said first oxidizer, said second oxidizer operating at an average internal temperature ranging from 1800° F. to 2800° F.;

passing gaseous combustion products and unmelted particulate material from said second oxidizer to a cooling and neutralizing vessel in flow communication with said second oxidizer;

cooling said gaseous combustion by-products and unmelted particulate material from said second oxidizer to a temperature below about 400° F. in said vessel by injecting a liquid comprised of water therein;

neutralizing acid in said gaseous combustion by-products from said second oxidizer by injecting a caustic liquid into said vessel to form a neutralized gaseous effluent and cooled particulate material;

separating said neutralized gaseous effluent from said cooled particulate material by dry filtration;

exhausting said neutralized gaseous effluent;

combining and accumulating said cooled particulate material and said primary aggregate;

periodically introducing said combined cooled particulate material and primary aggregate into the second oxidizer to form a pile adjacent to the bottom of said second oxidizer, said pile having a sloped exterior surface;

impinging heat from said first oxidizer on said sloped surface of said pile and melting at least a portion of the material therein;

combining the molten material and any unmelted material entrained therein with said molten slag to form a substantially molten mixture;

removing said substantially molten mixture from said oxidizers; and cooling said substantially molten mixture to form said non-hazardous, non-leaching aggregate.

32. The process of claim 31 wherein said waste fines comprise contaminated soil.

33. The process of claim 31 wherein said auxiliary fuel comprises combustible liquid waste material.

34. The process of claim 33 wherein said combustible liquid waste material comprises a liquid selected from the group consisting of: organic solvents, waste petroleum products, liquid drilling waste, paint and other organic and inorganic liquids.

35. The process of claim 31 including the step of injecting liquids into said second oxidizer.

36. An apparatus for converting hazardous waste into non-hazardous, non-leaching aggregate, said apparatus comprising:

a rotary kiln having an entry portion and an exit end;

oxidizing means adjacent the entry portion of said kiln;

a source of solid waste material, said solid waste material comprising large solid waste and waste fines;

means for separating said large solid waste from said waste fines;

means for introducing said large solid waste to said entry portion of said rotary kiln;

means for introducing said waste fines to said oxidizing means;

means for inducing combustion in said kiln to convert said large solid waste to solid particulate primary aggregate, clinker, volatile gases and gaseous combustion by-products;

means for separating said clinker from said solid particulate primary aggregate;

means for inducing combustion in said oxidizing means to convert said waste fines, said volatile gases and said gaseous combustion by-products into non-combustible fines, molten slag, and waste gas;

means for passing said gaseous combustion by-products from said kiln and said waste gas from said oxidizing means;

means for cooling said non-combustible fines and said waste gas;

means for separating said non-combustible fines and said waste gas;

means for introducing said solid particulate primary aggregate and reintroducing said non-combustible fines, to said molten slag to form a substantially molten mixture; and means for cooling said substantially molten mixture to form said non-hazardous, non-leaching aggregate.

37. The apparatus of claim 36 wherein said oxidizing means comprise a plurality of refractory-lined vessels in flow communication with the entry portion of said rotary kiln.

38. The apparatus of claim 37 wherein said oxidizing means includes a first oxidizer disposed to receive said waste fines, volatile gases from said kiln and gaseous combustion by-products from said kiln.

39. The apparatus of claim 38 wherein said apparatus includes means for injecting auxiliary fuel into said first oxidizer.

40. The apparatus of claim 38 wherein said apparatus includes means for injecting oxygen gas into said first oxidizer.

41. The apparatus of claim 38 wherein said first oxidizer includes a burner for heating material therein.

42. The apparatus of claim 36 including means for introducing said non-combustible particulate fines and said primary aggregate into said oxidizing means.

43. The apparatus of claim 42 wherein said means for introducing said non-combustible particulate fines and said primary aggregate comprises an accumulator for receiving said non-combustible particulate fines and said primary aggregate.

44. The apparatus of claim 43 wherein said accumulator includes means for accumulating said non-combustible particulate fines and said primary aggregate until the level of material in said accumulator reaches a predetermined level, valve means associated with said accumulator being disposed to allow accumulated non-combustible particulate fines and primary aggregate to pass into said oxidizing means.

45. The apparatus of claim 39 including means for introducing said non-combustible particulate fines and said primary aggregate into said first oxidizer.

46. The apparatus of claim 38 including means for removing said molten slag from said first oxidizer.

47. The apparatus of claim 38 including a second oxidizer in flow communication with said first oxidizer.

48. The apparatus of claim 47 including means for introducing said non-combustible particulate fines and said primary aggregate into said second oxidizer.

49. The apparatus of claim 47 including means for injecting liquids into said second oxidizer.

50. The apparatus of claim 47 wherein said apparatus includes a conduit between said first and second oxidizers.

51. The apparatus of claim 50 wherein said conduit includes means for removing said molten slag from said oxidizing means.

52. The apparatus of claim 49 wherein said conduit includes a burner for heating material therein.

53. The apparatus of claim 36 wherein said cooling means comprises a cooling vessel in flow communication with said oxidizing means, said cooling means including means for injecting water into said cooling vessel.

54. The apparatus of claim 53 wherein said water is injected into said vessel at a supersonic velocity.

55. The apparatus of claim 53 further including means for injecting caustic liquid into said cooling vessel to neutralize acid in said waste gas.

56. The apparatus of claim 36 wherein said means for separating non-combustible fines and waste gas comprise a baghouse.

57. The apparatus of claim 36 wherein said means for passing said gaseous combustion by-products from said kiln and said waste gas from said oxidizing means includes means for inducing sub-atmospheric pressure in said apparatus.

58. The apparatus of claim 57 wherein said pressure reducing means comprise at least one fan associated with said separating means.

59. The apparatus of claim 36 wherein said means for separating said larger solid waste from said waste fines comprise said rotary kiln.

* * * * *